United States Patent [19]

Herzig

[11] 4,241,470

[45] Dec. 30, 1980

[54] MORTAR TROUGH

[76] Inventor: John Herzig, R.R. #2, Box 1412, Paulding, Ohio 45879

[21] Appl. No.: 35,549

[22] Filed: May 3, 1979

[51] Int. Cl.[3] ..... E04G 21/20

[52] U.S. Cl. ..... 15/235.4; 52/749; 294/3.5; 294/55

[58] Field of Search ..... 294/1 R, 3.5, 49, 55; 15/235.3–235.8; 52/747, 749, DIG. 1

[56] References Cited

U.S. PATENT DOCUMENTS

| | | | |
|---|---|---|---|
| 1,321,532 | 11/1919 | Mann | 15/235.6 |
| 2,181,209 | 11/1939 | Seeman et al. | 15/235.7 |
| 3,608,944 | 9/1971 | Turner | 294/3.5 |
| 3,804,450 | 4/1974 | Guenzel | 294/55 X |
| 4,079,977 | 3/1978 | Linse | 294/3.5 |

FOREIGN PATENT DOCUMENTS

| | | | |
|---|---|---|---|
| 531641 | 10/1956 | Canada | 52/749 |
| 1087477 | 2/1955 | France | 52/749 |
| 124472 | 3/1949 | Sweden | 52/749 |

*Primary Examiner*—Johnny D. Cherry

*Attorney, Agent, or Firm*—Clarence A. O'Brien; Harvey B. Jacobson

[57] ABSTRACT

A tool or building construction implement is disclosed for use in constructing brick work, particularly for use by a bricklayer in construction of brick walls, or other brickwork, of conventional bricks and mortar. With use of the present invention, need is eliminated for the usual mortar board and trowel. The mortar trough is semi-cylindrical in shape, containing when filled with mortar the exact amount of mortar required to prepare brick joints cleanly and with savings of mortar otherwise wasted when excessive amounts are applied. The mortar trough requires no handle, and can be used for work in crowded places, such as under an overhang, near walls, and the like. In a first method of use, rotation substantially about a longitudinal axis allows deposition of the mortar contents on the row of bricks to be built up with an additional layer. In a second method of use, the trough can be filled and tilted to permit the mortar contents to flow along the surface to be worked. The trough is closed at one end and left open at the opposite end.

7 Claims, 5 Drawing Figures

Fig. 1
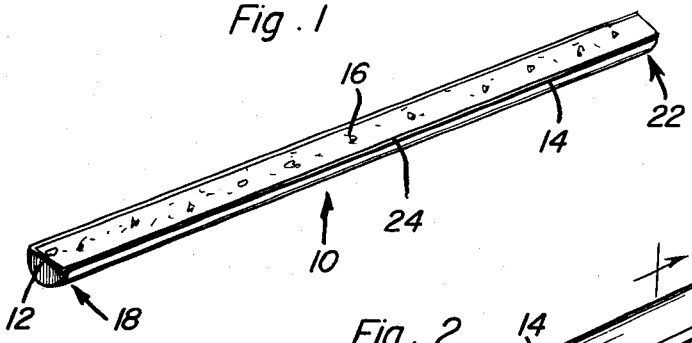
Fig. 2
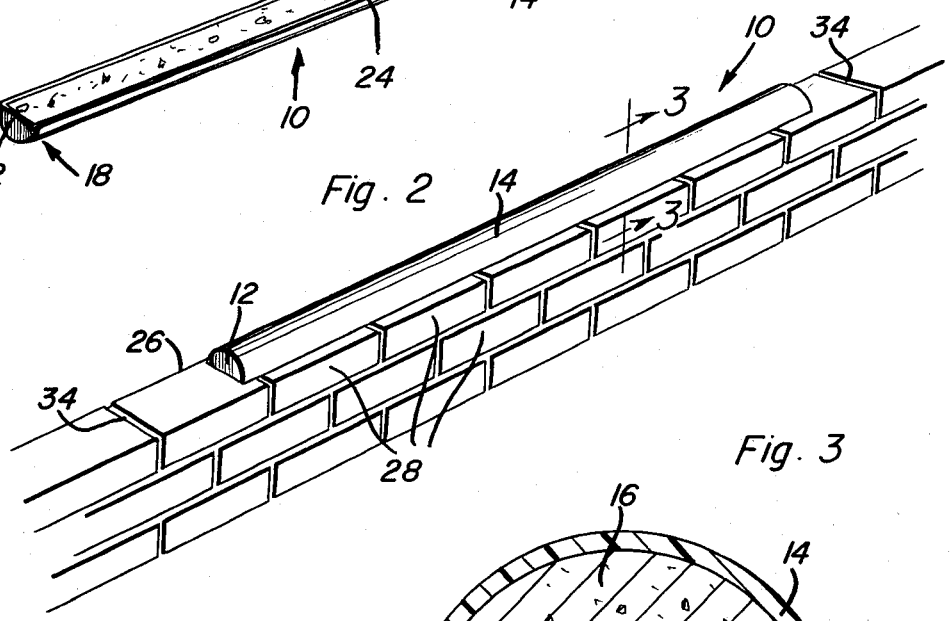
Fig. 3
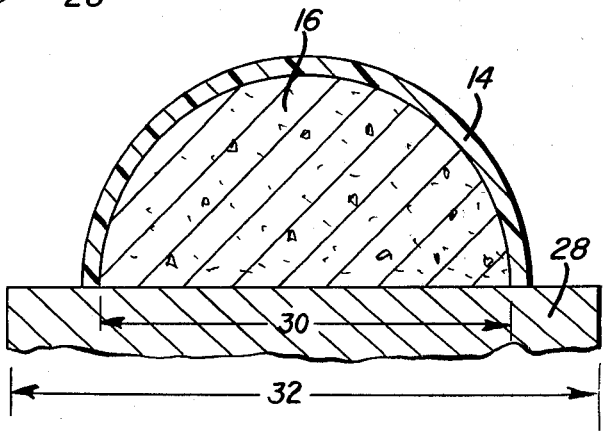
Fig. 5
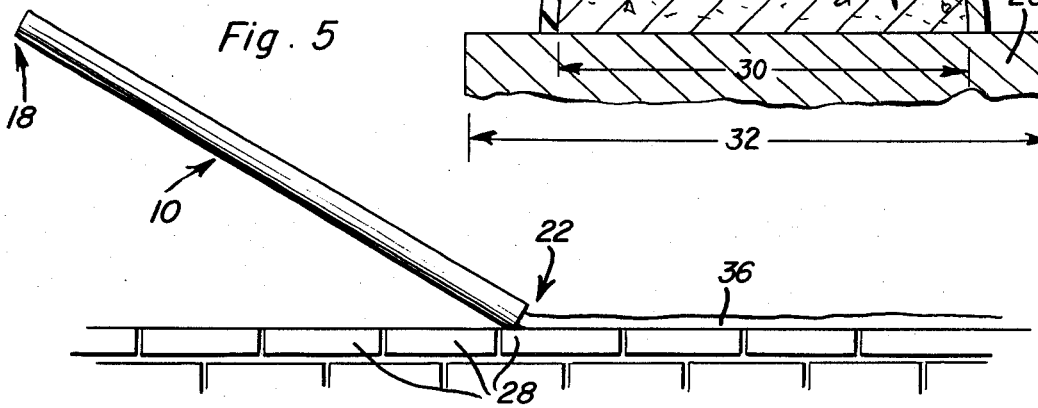
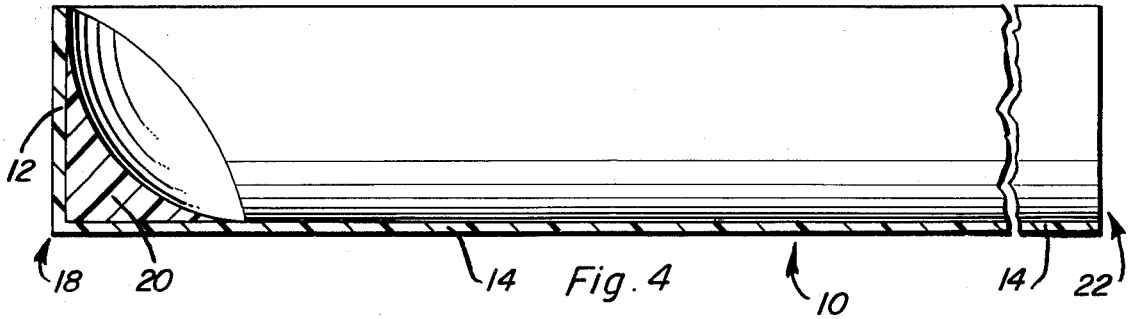
Fig. 4

MORTAR TROUGH

BACKGROUND OF THE INVENTION

1. Field of the Invention

The invention relates to construction work implements, specifically for use in bricklaying. More particularly, with the mortar trough device of the invention, need for a mortar board and trowel can be eliminated, making bricklaying work proceed more quickly, neatly and cleanly. Further, supplies of mortar can be conserved with use of the invention, and work in crowded or cramped locations is facilitated.

2. Disclosure Statement

In U.S. Pat. No. 3,608,944, issued Sept. 28, 1971, to W. V. Turner, a trowel is disclosed having an open end, with the opposite end mounting a handle and being closed with a triangular base plate, where the trowel is used for laying mortar by rotation about the longitudinal axis. However, the Turner trowel is especially adapted for use within blocks, usually 15" to 18" long. The handle device of Turner would be limited by the difficulty in lifting from the handled end and accordingly cannot lay a quantity of mortar substantially greater than the length specified. Further, the Turner device has an enclosed end in which mortar is inclined to build up, as is expected from a closed end formed at a 90° angle. Further, the Turner device is formed from a quarter of a cylinder, and accordingly, forms a relatively shallow trough having a limited mortar carrying capacity. This is not surprising in view of the disclosed utility as a trowel and a device for laying a thin bead or layer of mortar on a narrow brick or block surface. In U.S. Pat. No. 3,804,450, issued Apr. 16, 1974, to H. O. Guenzel, a hand tool having an elongated grip handle at one end and an open end. The tool is disclosed at column 3, lines 56 to 58 as useful as a mason's trowel in working with cement. However, the Guenzel device is limited in the length obtainable in view of the handle means which limits the utility to relatively short scoop lengths. In U.S. Pat. No. 1,327,151, issued Jan. 6, 1920, to P. L. Frazier, a generally semi-circular jointer tool is disclosed where the blade is curved longitudinally. Such a curvature prevents uniform application of mortar, either by tipping to allow flow from the open end, or by rotation about a longitudinal extent.

In U.S. Pat. No. 1,321,532, issued Nov. 11, 1919, to O. F. Mann, a mortar trowel can be used to place a measured uniform width and thickness of mortar on a wall under construction, as well as to cause the mortar to be forced down into the joint openings between the bricks or stones in the uppermost course thereof. However, such a mortar gauging trowel as is disclosed in the Mann patent requires a consistency of mortar which is relatively viscous. The thinner, less viscous quality of mortar necessary during hot weather due to the drying factor under such conditions could not be successfully accommodated. Moreover, the length of the Mann trowel is limited by the inclusion of a handle arranged at the end of the device.

Other patents deemed less pertinent but related to the field of the invention include the following:

U.S. Pat. Nos. 2,167,699—Aug. 1, 1939—W. J. Weesner 4,079,977—Mar. 21, 1978—A. J. Linse.

SUMMARY OF THE INVENTION

An elongated mortar trough is disclosed having a simple semi-cylindrical construction and not requiring a handle in association therewith. With the absence of a handle to limit the length of mortar trough which can be conveniently manipulated, lengths of about 4' or more are possible, enabling a bead or layer of mortar to be applied in such lengths. Inasmuch as the mortar trough is constructed in precisely the size corresponding to the exact amount of mortar needed for proper joints for a given size of brick or block, neither mortar board nor trowel are needed for laying a course of such brick or block.

Accordingly, a primary object of the invention is to provide a construction tool for applying a controlled quantity of mortar on a brick or block structure under construction to enable a new course of brick or block to be laid without use of conventional mortar board or trowel.

Another object of the invention is to provide such a mortar trough in precisely the dimension which permits exactly the quantity of mortar to be deposited which is required, thereby avoiding depositing of excess mortar and saving in wastage.

Still another object is to enable bricklaying work to be conducted more easily, quickly, neatly and cleanly.

Yet another object is to provide a mortar trough having a closed end and an open end, where the closed end is rounded to enable easy cleaning in the vicinity of the inside of the closed end.

A further object is to provide a method for expeditious use of the mortar trough, wherein the filled trough is rotated axially to deposit the mortar contents along the uppermost course of brick or block on which construction is proceeding.

Another further object is to provide an advantageous method of use wherein the mortar trough is tilted with the closed end uppermost, thereby permitting flow of mortar from the lower end upon the course of brick or block on which further building is to proceed.

Yet another further object is to provide a mortar trough having a diameter sufficient to contain exactly that quantity of mortar necessary for a particular width of brick or block and, accordingly, to provide mortar troughs in a range of diameters to provide adaptability to varying construction industry needs.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the mortar trough of the present invention after filling with a quantity of freshly prepared mortar.

FIG. 2 is a perspective view of the mortar trough of FIG. 1 after inverting accordingly to the first method of use of the invention.

FIG. 3 is a transverse sectional view of the mortar trough of FIG. 2, showing fragmentarily the upper portion of a brick upon which the mortar trough and enclosed mortar contents are resting.

FIG. 4 is a longitudinal sectional view of the mortar trough of the present invention, showing details of the rounded closed end.

FIG. 5 is a side elevational view of the mortar trough of the invention depositing the mortar contents by flow from the open end to form a layer of mortar on a course of bricks.

DESCRIPTION OF THE PREFERRED EMBODIMENT

Mortar trough 10 in FIG. 1 is made up of end panel 12 and semi-cylindrical longitudinal wall 14. Trough 10 is filled with freshly prepared mortar 16, such as might be loaded from a conventional mortar mixing device or mortar transport device, such as a wheelbarrow. Preferably, mortar trough 10 is constructed of a plastic material, such that wall 14 has sufficient flexural strength to support the weight of mortar 16, yet exhibit properties of corrosion resistance and be light in weight. For example, trough 10 can be constructed from a plastic tube 3" in diameter, cut longitudinally into two substantially equal halves. Accordingly, such a semi-cylindrical trough is 3" in width and 1½" in depth. Panel 12, forming the outer portion of closed end 18 of mortar trough 10, is attached to wall 14 by a conventional adhesive, heat sealed, or otherwise sealingly attached thereto. Alternatively, panel 12 can be integral with wall 14, as illustrated in FIG. 4, such as is the case when mortar trough 10 is formed by injection molding, or other equivalent plastic working technique. As is further apparent in FIG. 4, closed end 18 of mortar trough 10 is provided with plug 20, thereby providing a rounded interior surface to promote ease of cleaning, as well as to balance the quantity of mortar dispensed at each end of mortar trough 10. Plug 20 is attached to panel 12 and wall 14 by conventional means, such as a suitable adhesive, bolting, or the like, or alternatively, plug 20 can be formed integrally by an injection molding technique, or other equivalent means of fabrication.

While materials of construction of panel 12, wall 14 and plug 20 have been illustrated to be a synthetic resin, and such material is preferred for the reasons stated above, other equivalent materials of construction, such as steel, aluminum, wood, or the like, can also be used. A plastic resin, however, offers the advantage of ease of construction, advantageous handling due to the lightweight nature of the material, absence of corrodability, and increased safety in operation during manipulative operations of carrying, lifting, or rotating.

The first method of use of the invention, best illustrated in FIGS. 2 and 3, in its first step calls for filling mortar trough 10 with mortar as illustrated in FIG. 1. Preferably open end 22 of trough 10 is elevated somewhat above the level of closed end 18 to prevent loss of mortar 16 by flow therefrom. The user of the device then aligns an edge 24 of wall 14 along an upper edge 26 of a course of bricks undergoing construction, the upper course being made up of individually laid bricks 28. The manual operation necessary to invert mortar trough 10 when filled with mortar is rendered more easily accomplished by the relatively high viscosity of contained mortar 16, as compared with liquids such as water. In the next step of the first method of use, mortar trough 10 is lifted upwardly, leaving precisely the correct quantity of mortar on the top edges of bricks 28 for laying the next course of brick.

EXAMPLE

When mortar trough 10 was constructed from a plastic 3" inside diameter tube cut longitudinally to produce semi-cylindrical mortar trough 10, and applied over bricks 28 in a manner shown in FIGS. 2 and 3, inside dimension 30 having the value 3", where brick 28 had a width 32 of 4", it was found that the exact quantity of mortar needed to make clean joints was delivered according to the method outlined above. Mortar trough 10 was constructed in a length of about 48", thereby enabling rapid and efficient carrying of mortar at the work site, reducing mortar wastage and enabling neat and clean joints 34 to be made.

In the second method of use of the invention, shown in FIG. 5, mortar trough 10 is first filled with mortar 16 as in FIG. 1, placed over the course of bricks 28 with closed end 18 in an upraised position as in FIG. 5. Open end 22 of trough 10 is moved leftwardly, while maintaining the angle of tilt of mortar trough 10 at the angle necessary to cause flow from trough 10 through open end 22 to form mortar bead 36 on bricks 28.

Inasmuch as the operator of mortar trough 10 can exercise a greater degree of control of the rate of outward flow of mortar 16 to form bead 36 in the second method of use of the invention, the second method offers greater versatility, in view of the possibility of varying the quantity of mortar delivered per unit length of brickwork. Accordingly, width 32 of brick 28 can vary somewhat from job to job for a given size of mortar trough 10, with the operator compensating for variations in width by adjusting the flow of mortar from trough 10. On the other hand, it can be seen that when used according to the first method, mortar trough 10 promotes even distribution of mortar, leaving little room for variances as between different individual bricklayers or as between differences in a single bricklayer's work. Accordingly, uniformity is promoted in appearance and construction, a consideration which can be of maximum importance when inexperienced trades persons are employed.

Inasmuch as the invention can be used in either mode without special adaptation, its versatility for use either by inexperienced or highly skilled bricklaying personnel can lead to greater efficiency, as well as economy, at a construction site.

Further, cleaning of mortar trough 10 is promoted by plug 20, inasmuch as accumulation of mortar in closed end 18 will not be favored and a minimum rinsing operation, such as can conveniently be accomplished when a plurality of mortar troughs are arranged in a row or inclined with the closed end tilted upwardly and the open end against the ground. The shape of trough with no interior recessed portions or corners enables a user to expeditiously clean one or a plurality of troughs 10 in this manner.

As is well-known in the art, during hot weather a relatively thin or less viscous mortar is needed to prevent premature drying or hardening under environmental conditions of elevated ambient temperatures. Advantages of use of mortar trough 10 will result irrespective of the viscosity of mortar, the device performing equally well with a relatively thin mortar having a higher proportion of water to solids, such as is typically used in the bricklaying art during hot weather, as well as the relatively thick mortar having a lower proportion of water to solids, as is used during relatively colder weather. Further, no mechanical force or pressure is needed to apply the mortar with the mortar trough of the present invention, promoting ease and simplicity in applying mortar with the present invention, as well as allowing a uniform layer of mortar to be applied in lengths of up to 4' or 5' at a time.

Further, the present invention avoids handle means, such as frequently exist on prior devices to lift or press such devices. With the present invention, simplicity of construction is promoted, with no handle means to get in the way of use, storage, or cleaning.

It is further apparent that the mortar trough of the present invention can be used to lay brick or block under an overhang or near an existing wall, inasmuch as space requirements are minimal, with no projecting handle means or other attachments to obstruct free motion of the device.

Neatness of work product at a construction site is promoted with the invention, since there is no mortar spillage on the face of bricks 28, thereby conserving the supply of mortar and minimizing or eliminating the necessity for subsequent cleaning of the face of the brick wall.

Savings in labor cost arise with use of the present invention not only in the speed, versatility and reduced clean up resulting from use as described hereinabove, but also in savings which accrue from the inherent simplicity of use of the device, which permits the above advantages to be realized with use of inexperienced or unskilled labor.

It should further be noted that the semi-cylindrical shape of wall 14 constituting the principal portion of mortar trough 10 promotes ease in cleaning the trough, inasmuch as no angular portions are present along the longitudinal extent of the device to provide locations where solid particles can easily lodge. Further, when walls 14 are constructed of a plastic or other hydrophobic material, ease of cleaning by rinsing is promoted due to the non-wettable nature thereof.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A hand construction tool for applying a bead of mortar to the upper surface of a course of bricks or blocks having a well defined and substantially constant width, in a quantity sufficient and not excessive to form in combination with additional of said bricks or blocks the next higher course of bricks or blocks in building, the tool comprising an elongated semi-cylindrical wall and a panel closing and defining one end of the wall, a solid plug fittingly insertable and attachable in the end of the construction tool closed by said panel, the plug presenting a sealed flat surface to said panel and a sealed surface to said wall and presenting a rounded surface to the interior portion of the construction tool in which said mortar is containable, the elongated wall having a diameter bearing a relationship to said constant width such that the quantity of mortar deliverable by the tool constitutes that quantity of mortar sufficient and not excessive to form said next higher course, whereby wastage of mortar and spillage of mortar on the face of said bricks or blocks is substantially eliminated.

2. The construction tool of claim 1 wherein said elongated semi-cylindrical wall has a length substantially in excess of the diameter of the elongated wall, and the end of the semi-cylindrical wall remote from the end of the wall defined by said panel is open.

3. The construction tool of claim 1 wherein said relationship is such that the ratio of said elongated wall diameter to said width is approximately 0.75.

4. The construction tool of claim 3 wherein said elongated wall has a length of at least about 4 feet.

5. The construction tool of claim 1 wherein the semi-cylindrical wall has a length approximately 16 times said diameter.

6. The construction tool of claim 5 wherein said diameter is approximately 3 inches.

7. The construction tool of claim 1, wherein said tool does not include a handle means.

* * * * *